US005331792A

United States Patent [19]

Kitchen

[11] Patent Number: 5,331,792

[45] Date of Patent: Jul. 26, 1994

[54] PACKAGING UNIT

[75] Inventor: Robert W. Kitchen, Elmira, Mich.

[73] Assignee: Kitchen Farms, Inc., Elmira, Mich.

[21] Appl. No.: 985,766

[22] Filed: Dec. 4, 1992

[51] Int. Cl.[5] ..... B65B 1/32; B65B 35/24

[52] U.S. Cl. ..... 53/502; 53/244; 53/251; 53/259

[58] Field of Search ..... 53/502, 501, 500, 244, 53/245, 251, 259, 534

[56] References Cited

U.S. PATENT DOCUMENTS

| | | | |
|---|---|---|---|
| 2,654,518 | 10/1953 | Kindseth . | |
| 2,784,749 | 3/1957 | Baker | 141/314 |
| 2,949,714 | 8/1960 | Davis | 53/63 |
| 3,097,459 | 7/1963 | Rausch | 53/59 |
| 3,215,173 | 11/1965 | Rutherford | 141/83 |
| 3,406,727 | 10/1968 | Rexus | 141/131 |
| 3,416,620 | 12/1968 | McClusky | 177/123 |
| 3,498,020 | 3/1970 | Eppenberger | 53/55 |
| 3,540,497 | 11/1970 | Troyer | 141/314 |
| 3,705,475 | 12/1972 | Riley | 53/501 X |
| 3,738,077 | 6/1973 | Leach | 53/502 |
| 3,842,569 | 10/1974 | McClelland et al. | 53/57 |
| 4,526,214 | 7/1985 | McGregor | 141/59 |
| 4,606,475 | 8/1986 | Usagawa | 53/502 X |
| 4,607,478 | 8/1986 | Maglecic | 53/502 |
| 5,001,889 | 3/1991 | Mueller | 53/502 |
| 5,050,370 | 9/1991 | Stederoth | 53/502 |

*Primary Examiner*—James F. Coan
*Attorney, Agent, or Firm*—Howard & Howard

[57] ABSTRACT

A packaging assembly for packaging a pre-measured quantity of products particularly irregular-shaped products such as potatoes into a bag or other container. The assembly includes a plurality of transfer conveyors mounted upon a turntable for transferring the pre-measured quantity of product to the bag. The conveyor allows the product to be slowly conveyed to the bag to avoid clogging of the product between the weighing station and the bag. Additionally, clogging is reduced by the sidewalls surrounding the conveyor being generally pyramid-shaped, facilitating the transfer of the product to the bag.

25 Claims, 3 Drawing Sheets

PACKAGING UNIT

FIELD OF THE INVENTION

The present invention relates to a packaging unit for packaging materials and more particularly for packaging irregularly shaped materials such as foodstuffs and in particular potatoes.

BACKGROUND OF THE INVENTION

A typical packaging unit for packaging materials such as foodstuffs includes a weighing station for weighing a predetermined amount of material to be packaged and a funnel which receives and then discharges the weighed material to a bag or other receptacle. There is a tendency for the material to clog in the funnel. As should be apparent, clogging dramatically reduces the speed at which the packaging unit can operate. This is a particular problem when potatoes are packaged. Due to their irregular shape and size, there is a regular tendency for potatoes to stick within the funnels disrupting the packaging process.

This problem of clogging, particularly in food packaging and even more particularly in potato packaging was addressed in U.S. Pat. No. 5,001,889, issued to Alan Mueller on Mar. 26, 1991. Recognizing that clogging of the funnel is a problem, Mueller vibrated a carousel upon which funnel shaped hoppers were mounted. The carousel was vibrated in two separate directions in order to keep foodstuffs from becoming stuck in the funnel. However, the problem with vibrating the carousel is that it can further wedge foodstuffs within the funnel. Once the product such as potatoes become wedged in the funnel, there is a tendency for vibration of the funnel to further wedge the potatoes and to wedge other potatoes as well.

SUMMARY OF THE INVENTION

The present invention overcomes the above disadvantage by providing a packaging unit that avoids clogging between the weighing station and the bag. Briefly, the invention employs a conveyor positioned between the weighing station and the bag which slowly conveys the product to the package. This insures that their is no clogging.

The packaging unit of the present invention is particularly suited for packaging potatoes. It includes at least one transfer conveyor for transferring the materials to be packaged to a bag. The conveyor has a first end that receives a quantity of potatoes and a second end for discharging the potatoes into the bag.

The unit includes a weighing station for separating by weight the product to be packaged from a bulk quantity of product. In the preferred embodiment of the invention, the weighing station discharges the product onto the transfer conveyor. The product is dispersed along the conveyor as the conveyor moves. The product cannot clog because the conveyor is moving the individual pieces of product toward the bag as they are dropped into the bag. This avoids the bunching of product which normally results in clogging problems. As a result, at the discharge end of the conveyor only a small number of the product is dropped into the bag until all the product has been packaged.

In the preferred embodiment of the invention, the packaging unit includes a plurality of transfer conveyors mounted upon a rotatable base. The transfer conveyors extend radially outwardly along the periphery of the rotatable base. Bag holders are mounted adjacent the second ends of the transfer conveyors for holding a bag adjacent the second end of each transfer conveyor. The conveyors with bags attached are rotated to a position under a hopper which holds a pre-weighed quantity of product. When properly positioned, the hopper opens and drops the product on the conveyor for conveyance to the bag.

The transfer conveyors are specially designed to further prevent any clogging of the product to be packaged. The surface of the conveyor is uneven for imparting a rolling motion to the product as it is being conveyed along the conveyor. In the preferred embodiment, the uneven surface approximates a sinusoidal wave and is basically constructed of a plurality of half cylinders extending laterally across the surface of the conveyor.

To further facilitate the transfer of the product to the package, the transfer conveyors include sidewalls. Preferably, these sidewalls are defined by inwardly projecting pyramids that have four sides meeting at an apex at approximately the center of the sidewall. The top portion of the pyramid is directed in a downward direction toward the conveyor belt to guide the product to the belt. The base portion of the sidewall is directed upwardly to obstruct the upward movement of the product once it passes the apex of the pyramid. The right and left portions of the pyramid help to further guide the product.

DETAILED DESCRIPTION OF THE INVENTION

Figure 1:
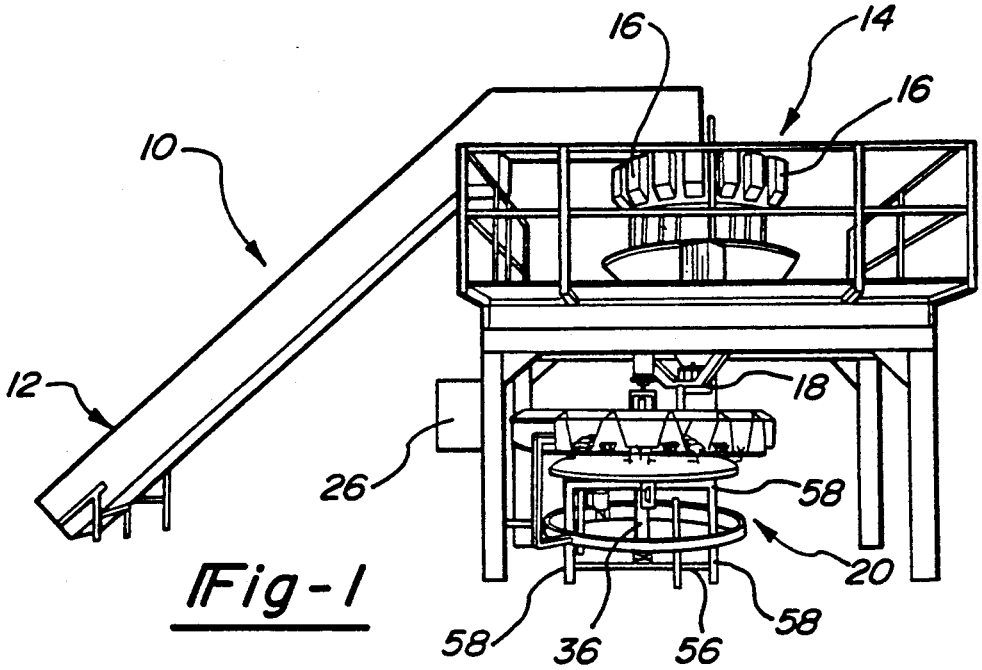
FIG. 1 is a plan view of the packaging unit of the present invention.

With reference to FIG. 1, the packaging unit of the present invention is shown generally at 10. Broadly, the packaging unit includes a conveyor 12 for conveying a quantity of product to be packaged from a bulk supply to a weighing station 14. In the preferred embodiment the product being packaged is potatoes. It should be understood; however, that many different products could be packaged with this unit and in particular irregularly-shaped products.

Weighing station 14 is a commercially available weighing station purchased from Eagle Packaging located at Oakland, Calif. Weighing station 14 accepts bulk amounts of potatoes and separates them into various compartments 16 which signal the weight of the potatoes in the respective compartments until a predetermined weight of potatoes, usually 5, 10 and 20 pounds, is achieved from a selective sampling of the compartments. Once the desired weight of potatoes is obtained, the respective compartments 16 open, discharging the potatoes from the weighing station to a hopper 18 which in turn discharges the potatoes to the conveying station 20 and in particular to one of the transfer conveyors 25.

The hopper 18 has a door 22 controlled by a fluid cylinder 24. The fluid cylinder is actuated to open the doors 22 and discharge the pre-weighed quantity of potatoes into the transfer conveyor 25 when a transfer conveyor 25 having a bag attached is below the hopper 18. The fluid cylinders are preferably pneumatic cylinders and are controlled from a master control panel 26. All operations of the unit 10 are likewise controlled through panel 26. Through the use of sensing devices, such as for example an electronic eye, the fluid cylinder can be controlled to actuate only when a transfer conveyor 25 is properly positioned below the doors 22 to avoid the products missing the bag. In the preferred embodiment, an electronic eye manufactured by Banner is used to ensure proper placement of the hopper below the doors 22.

Figure 7:
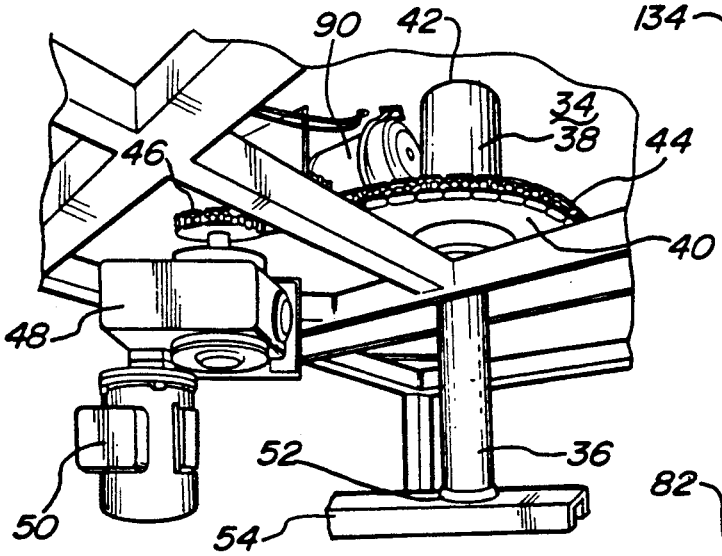
FIG. 7 is a partial perspective view of the bottom of the turntable of the present invention.

The conveying station 20 includes a plurality of transfer conveyors 25 mounted about the periphery of a turntable 34. The turntable 34 is mounted upon a vertical axis 36 and is rotated about axis 36. With reference to FIG. 7, the preferred method of rotating turntable 34 is illustrated. A tubular shaft 38 having a gear 40 mounted upon it is attached by welding or other means 42 to the base of turntable 34. Shaft 38 has an inside diameter which is greater than the outside diameter of shaft 36 so that shaft 38 can fit over shaft 36 and rotate upon shaft 36. A bearing assembly can be used between shafts 36 and 38 to facilitate rotation. A chain drive 44 connects gear 40 to the output 46 of a gear box 48. The gear box is powered by an electric motor 50 which in the preferred embodiment is a 220 volt 3-phase motor. The gear box 48 reduces the output of electric motor 50 so that the turntable 34 is turned slowly through 360° revolutions. An electronic speed controller or transistor inverter is used to further control the speed of the motor, the manufacturer of which is Toshiba. This allows the speed to be varied. In the preferred embodiment, turntable 34 rotates at a speed of 1 to 4 revolutions per minute.

With further reference to FIG. 7, in the disclosed embodiment shaft 36 is mounted through a bracket 52 to a frame assembly 54 which includes base 56 and top members 58. See FIG. 1. The gear box 48 and motor 50 are mounted to the frame structure and in particular to the top frame structure 56. The frame structure also includes downwardly extending legs 58 to support the conveying station 20.

Figure 2:
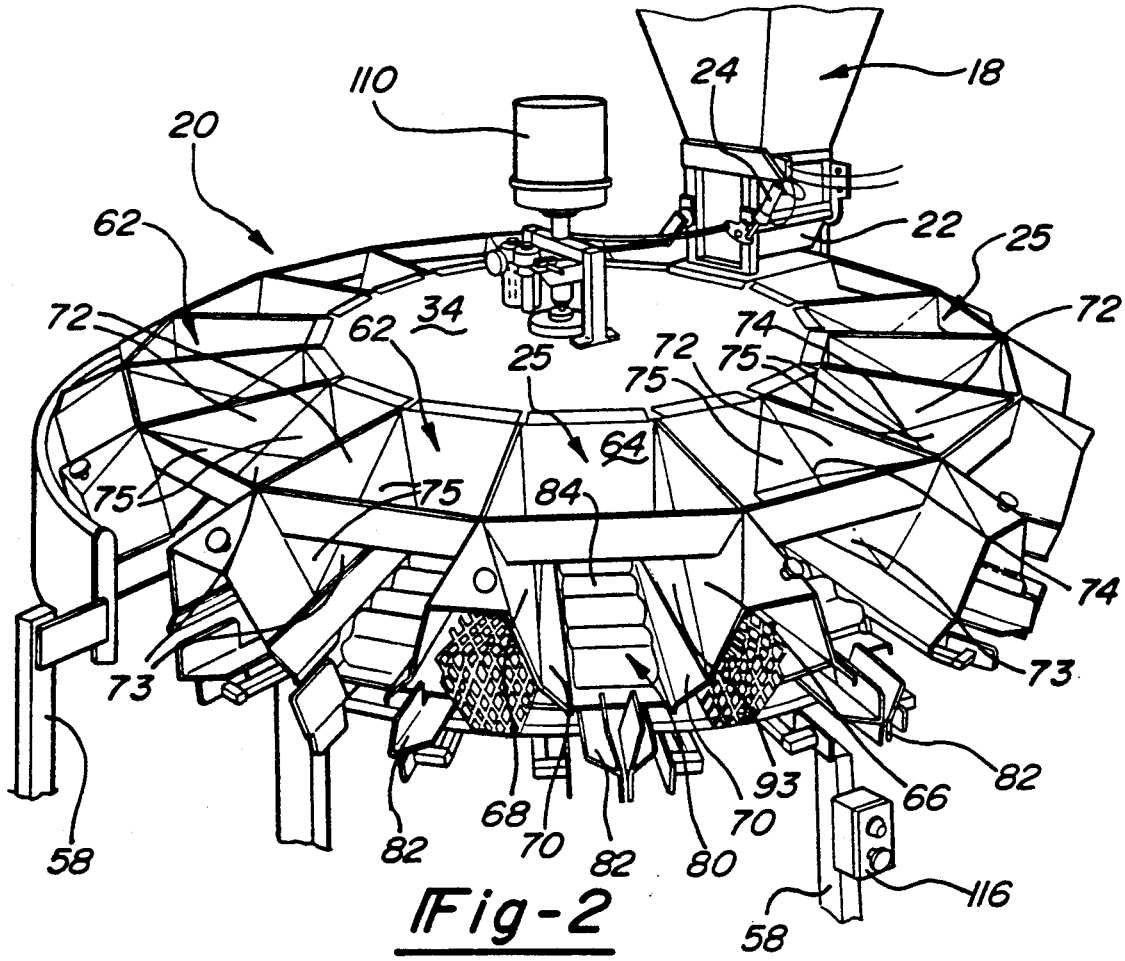
FIG. 2 is a perspective view of the transfer conveyor of the present invention.
Figure 3:
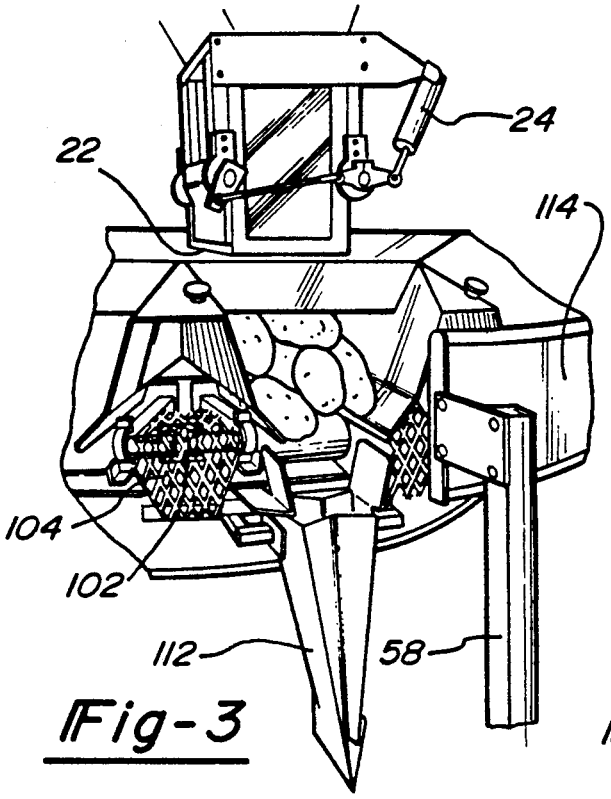
FIG. 3 is a partial perspective view of the transfer conveyor of the present invention filling a bag with potatoes.
Figure 4:
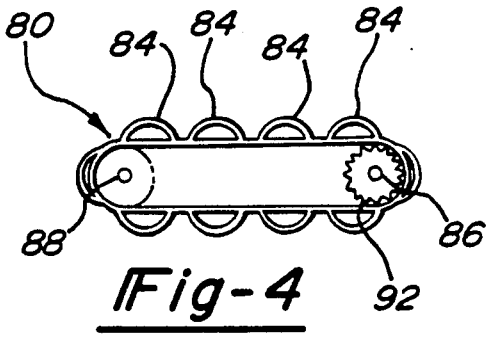
FIG. 4 is a side view of the conveyor belt used in the transfer conveyor of the packaging unit of the present invention.

Referring to FIGS. 2 through 4, the transfer conveyors 25 will be described in greater detail. As can be seen in FIG. 2, in the preferred embodiment there are 16 transfer conveyors. Each conveyor includes a 3-sided receptacle 62 having a rear wall 64 and side walls 66 and 68 respectively. The side walls 66 and 68 are inclined slightly inwardly and have a steeper inclined base 70. Additionally, each of the side walls 66 and 68 are defined by inwardly projecting pyramid-shaped surfaces having 4 sides 72 that extend inwardly to an apex 74. The top portion 72 of the pyramid is directed in a downward direction toward the conveyor belt to guide the product to the belt. The lower portion 73 of the pyramid is directed upwardly to obstruct the upward movement of the product once it passes the apex 74 of the pyramid. The right and left portions 75 of the pyramid help to further guide the product. In the preferred embodiment, the walls are made of stamped steel.

The base of the transfer conveyor 25 is defined by a conveyor 80. Conveyor 80 operates in a direction radially outwardly from the center of the turntable conveying the potatoes which it receives slowly through the receptacle 62 to an awaiting bag or other container for packaging. In the disclosed embodiment, the bags are held by bag holders 82 which will be described in greater detail below.

With reference to FIG. 4, the preferred conveyor 80 is illustrated. In the preferred embodiment, conveyor 80 has an uneven surface defined by half cylinders 84 extending laterally across the surface of the conveyor belt 80. In this way, as the conveyor belt rotates about axles 86 and 88, a rolling motion is imparted to the material being conveyed to encourage transfer of the material to the bag.

Figure 8:
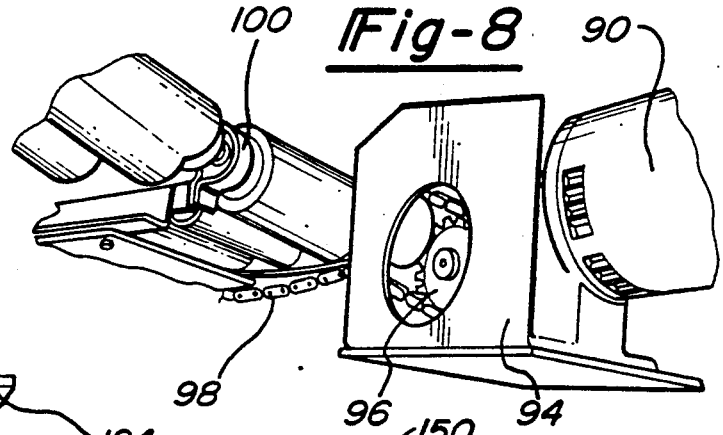
FIG. 8 is a further partial perspective view of the bottom of the turntable of the present invention.

The conveyor is powered by an electric motor 90 which is shown in FIGS. 7 and 8. Motor 90 is coupled to a gear 92 on axle 86 of the conveyor. In the preferred embodiment axle 86 is adjacent the discharge end of conveyor 80 nearest the bag holders 82. Referring to FIG. 8, it can be seen that motor 90 is mounted within a housing 94 which in turn is mounted to the base of turntable 34 so that the motor housing as well as the conveyor which is also mounted to turntable 34 rotate with turntable 34. A gear 96 is mounted to a gear box, not shown, and is powered by motor 90. Chain drive 98 supplies power from motor 90 through the gear box to the conveyor 80. As can be seen, axle 88 is mounted within a bearing 100 with a similar bearing being used to mount axle 86. Additionally, each axle 86 is connected to an adjoining axle 86 by a universal joint 102 so that the power being supplied by motor 90 can be supplied to all 16 conveyors through the universal joint. The universal joint 102 can be seen behind the screen 104 in FIG. 3.

Referring now to FIG. 2, in the preferred embodiment, motor 90 receives electric power through collector ring 110. As should be appreciated, the motor 90 is rotating with the turntable and therefor connecting it through ordinary electric cables would be difficult. In order to overcome this problem, collector ring 10 is provided which receives power, preferably 220 volt 3-phase, and then transfers that power through brushes to an armature which is connected to motor 90. The collector ring 110 is commercially available.

Figure 5:
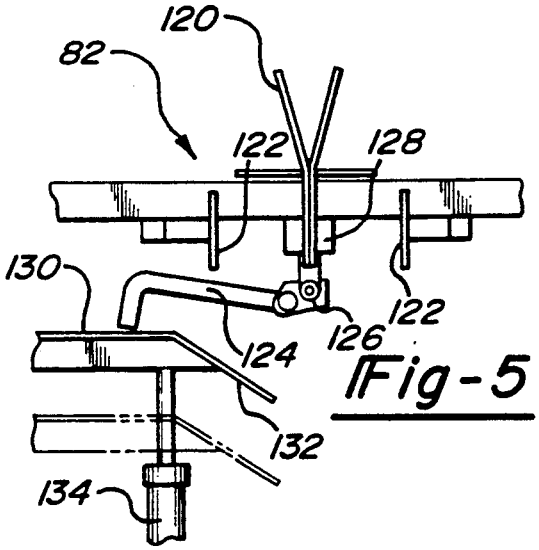
FIG. 5 is a partial front view of the bag holder of the packaging unit of the present invention with the bag holder in the closed position.
Figure 6:
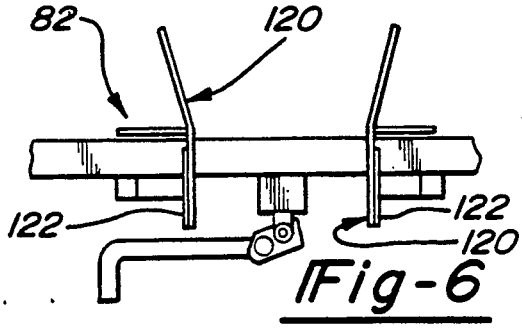
FIG. 6 is similar to FIG. 5 with the bag holder in the open position corresponding to the position it would have when holding a bag.
Figure 9:
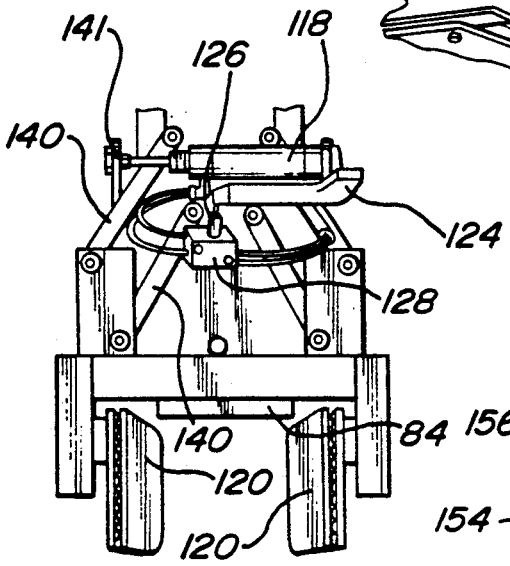
FIG. 9 is a view of the bag holder mechanism viewed from the bottom of the turntable.

With reference to FIGS. 5, 6 and 9, the bag holders used in the disclosed embodiment are generally illustrated at 82. Each of the transfer conveyors 25 have a bag holder 82 at the discharge end of the conveyor 80. Each bag holder 82 has a pair of arms 120 that open against a support 122. In the preferred embodiment, the adjacent sides of arms 120 and supports 122 have a rough surface, generally having sandpaper attached, to help grip the bag between the adjacent surfaces. The opposite side of each arm 120 is flared outwardly to form a large opening to receive the product as it is being discharged from the conveyor 80. Preferably, the flared ends of arms 120 are adjacent the steeper inclined base 70 of sidewalls 66 and 68 when arms 120 are open. This approximates a continuous surface for facilitating the conveyance of product to the bag.

The bag holders are preferably pneumatically controlled by a pneumatic cylinder 118 and operate between open and closed positions corresponding to the bag gripping position and the bag release position. The pneumatic cylinders are controlled by a lever arm 124 that is linked through a linkage 126 to a switch 128. In operation, the lever arm 124 rides along a surface 130 which corresponds to switch 128 signaling that the arms 120 remain closed to accept a bag 112. The surface 130 drops off at 132 which causes the lever arm 124 to drop down causing the switch to activate the cylinder 118 to open arms 120 to grip a bag 112. In the disclosed embodiment, the bags 112 are manually inserted over the arms 120 while the arms 120 are closed and the arms 120 then open to grip the bags. Once the bags are filled, the arms 120 close to release the bag which is then manually lifted out of the path of the next approaching bag. As should be appreciated, surface 130 only partially extends along the periphery of the turntable 34 corresponding to the portion of the cycle where the bag is being positioned upon the arms 120. A cylinder 134 is provided below surface 130 to allow the bag grippers to be opened if a potato gets caught between the grippers. In the preferred embodiment, cylinder 134 is controlled by a foot pedal. By actuating the pedal, the surface 130 can be lowered opening the gripper 120 to release the jammed potatoes.

With reference to FIG. 9, the bottom of the turntable 34 and the mechanism for controlling the arms 120 is illustrated. The arms are connected to linkages 140 which form a parallelogram. The opposite ends of linkages 140 are connected to cylinder 118 through brackets 141 only the left bracket is shown, and when cylinder 118 is energized, the linkages 140 open and close arms 120.

In operation, the product to be packaged is conveyed by conveyor 12 to the weighing station 14. Once the product to be packaged is discharged from conveyor 12 into the weighing station 14, the weighing station weighs a predetermined amount of the material and drops the material into hopper 18. Once at hopper 18, the pre-weighed material is held until a transfer conveyor 25 is rotated under hopper 12 by rotating turntable 34. Once a receptacle hopper 62 is in place, hopper 18 is prepared to be opened as long as a bag 112 is in position see FIG. 3. In the preferred embodiment, an electric eye is used to determine the proper location of bag 112 and to ensure that bag 112 is in position under hopper 18. Once the bag is in position, hopper 18 discharges the pre-weighed material to be packaged onto transfer conveyor 25 and it is conveyed by conveyor 80 into bag 112. Two electric eyes are used, one confirms the bag 112 is present and the other confirms that the receptacle 62 is properly in place.

Figure 10:
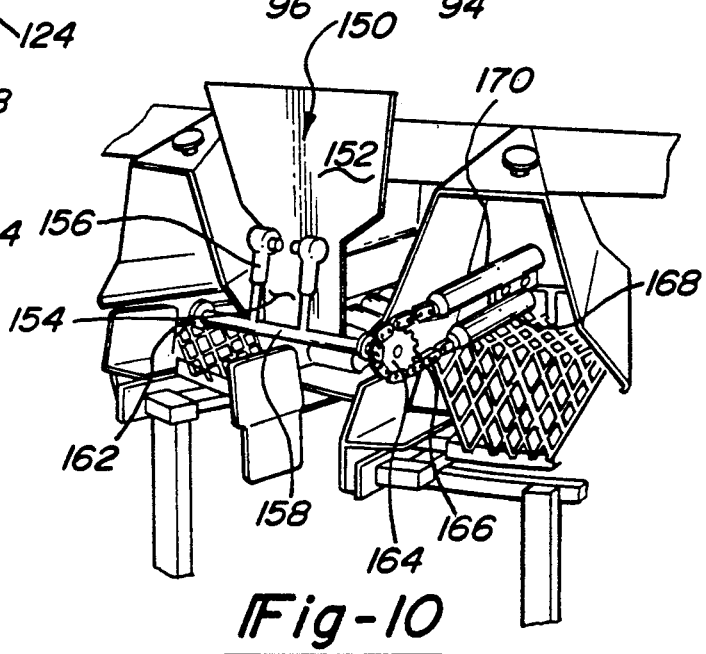
FIGS. 10 and 11 are partial perspective views of the bag opening mechanism.
Figure 11:
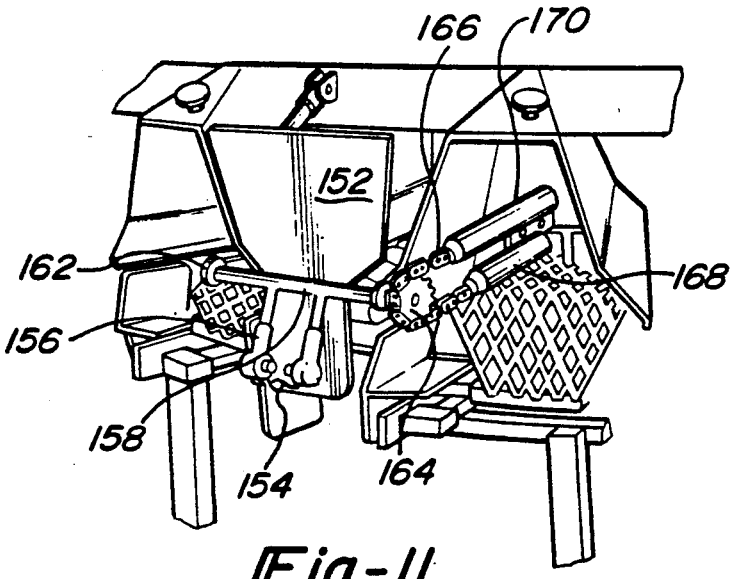

In the preferred embodiment, bag openers 150 are mounted to the ends of each transfer conveyor 25. With reference to FIGS. 10 and 11, the bag opener is shown generally at 150. The bag opener has a two-fold function. First, it opens the bag to ensure that the potatoes are properly deposited into the bag. Second, it serves as a door or end piece to direct the potatoes into the bag as they are being discharged from the conveyor. The bag opener has a top portion 152 that is generally U-shaped to close the end of the transfer conveyor 25. The shape of the upper portion is generally the shape of the opening at the discharge end of transfer conveyor 25. The bottom portion 154 of the bag opener is rectangular in shape and has a width which is less than the width of the bag. In this way, bottom portion 154 can be inserted into the bag and as the bag opener 150 travels through its operational path, the bag can be opened.

The bag opener 150 is mounted through pivot arms 156 to a pivot axis 158. The pivot arms 156 are attached by bearings 160 to the bag opener so that the bag opener is free to pivot with respect to the pivot arms. The opposite ends of the pivot arms are fixedly attached to the pivot axis 158 for example by welding. The pivot axis 158 is in turn connected by bearings 162 to the sidewalls 66 and 68 of receptacle 62. The bag opener 150 pivots between a raised position as shown in FIG. 10 to a lowered position as shown in FIG. 11. The travel path of the bag opener is through an arc. The face of the bag opener generally intersects the pivot axis when in the upright position. It is spaced from the pivot axis at the mid-point of its travel, at this point the face of the bag opener is furthest from the pivot axis. When in the lowered or bag open position, see FIG. 11, the face of the opener is again generally perpendicular to the pivot axis 158. As should be appreciated, from the mid-point of its travel path, the bag opener actually performs an opening function on the bag as it sweeps from the mid-point to the bag open position shown in FIG. 11.

A sprocket 164 is mounted to one end of pivot axis 158. The sprocket has a roller chain 166 mounted about it with one end of the roller chain connected to a driving means, preferably an air cylinder 168 and the other end connected to a biasing means, preferably a coil spring 170. The air cylinder 168 is used to raise the bag opener 150. The spring assists gravity to lower the bag opener 150. As should be appreciated, the air cylinder and spring are working in opposite directions to pull on the roller chain which is wrapped around sprocket 164. The air cylinder is timed so that as the receptacle 62 approaches hopper 18, the bag opener 150 is lowered by gravity and spring 170 to open the bag and close the discharge side of receptacle 62. As the receptacle 62 continues to be rotated, air cylinder 168 is actuated to raise bag opener 150 to the position shown in FIG. 10 with the bag holders 82 then opening to release the bag.

With reference to FIG. 3, a further embodiment of the invention is shown. A screen or shield 114 is positioned along approximately ½ of the diameter of turntable 34 to ensure that the material being packaged is not able to roll out of the open end of receptacle 16. Shield 114 effectively acts as a closed end for receptacle 62. As the turntable 34 continues to rotate along its revolution, the potatoes or other material to be packaged are slowly conveyed by conveyor 80 into the bag. In the preferred embodiment, it takes approximately one-half the rotation of turntable 34 to fully convey the potatoes into bag 112. Because of the slow conveyance of the potatoes, there is no clogging. Further, because of the rolling nature of the potatoes on the conveyor and due to the uneven surface of the conveyor, clogging is further prevented. Once the potatoes have been discharged, lever arm 124 is raised so that the bag can be withdrawn from the bag holders 82. Once a bag 112 is removed another is positioned upon arms 120. Lever 124 is then dropped to open the arms 120 against the bag 112 and stops 122. With reference to FIG. 2, a start stop switch 116 is employed to allow the unit to be started or shut down. Other than shut off 116, the unit is completely automated through panel 26.

As stated previously, in the preferred embodiment, the present invention is used to package potatoes. However, it should be understood by those of ordinary skill in the art that any material to be packaged, particularly material with irregular shapes, would find the present packaging unit to be advantageous. It will be apparent to those skilled in the art that the foregoing disclosure is exemplary in nature rather than limiting, the invention being limited only by the appended claims.

What is claimed is:

1. A packaging assembly for packaging foodstuffs into receptacles, said assembly comprising:

a plurality of transfer conveyors each of said transfer conveyors being adapted to a transfer a pre-measured quantity of said foodstuffs to a receptacle, each of said conveyors having a first end for receiving said pre-measured quantity of said foodstuffs and a second end for discharging said pre-measured quantity of said foodstuffs into one of said receptacles;

a rotatable base upon which said transfer conveyors are mounted;

said pre-measured quantity of said foodstuffs being dispersed along each of said conveyors as said conveyors move between said first and second ends such that said pre-measured quantity of said foodstuffs is deposited into one of said receptacles until said foodstuffs are packaged into said receptacles.

2. The packaging assembly of claim 1 further comprising a retractable door for closing the discharge end of each of said transfer conveyors, said door being movable between an open and closed position and when in said closed position, said door being adapted to hold one of said receptacles in the open position for receipt of said pre-measured quantity of foodstuffs.

3. The packaging assembly of claim 1, further including a single driving means for driving said plurality of transfer conveyors mounted upon said rotatable base.

4. The packaging assembly of claim 1, wherein said transfer conveyors include a belt and sidewalls along the length of said transfer conveyors, said sidewalls are defined by inwardly projecting pyramids that have four sides meeting at an apex at approximately the center of said sidewall, the top portion of said pyramid is directed in a downward direction toward said conveyor to guide said pre-measured quantity of said foodstuffs to said belt, the base portion of the sidewall is directed upwardly to obstruct the upward movement of said pre-measured quantity of said foodstuffs once it passes the apex of the pyramid, and the right and left portions of the pyramid help to further guide said pre-measured quantity of said foodstuffs.

5. The packaging assembly of claim 1, further comprising a weighing means for separating by weight said quantity of foodstuffs from a bulk quantity of foodstuffs and discharging said pre-measured quantity of said foodstuffs to said first end of said transfer conveyors.

6. The packaging assembly of claim 1, wherein said transfer conveyors have an uneven surface for imparting a rolling motion to said pre-measured quantity of said foodstuffs as said pre-measured quantity is conveyed along said transfer conveyors.

7. The packaging assembly of claim 6, wherein said uneven surface approximates a sinusoidal wave.

8. The packaging assembly of claim 1, wherein, said base is rotatable about a generally vertical axis; said base having a center and edge; said plurality of transfer conveyors extending radially outwardly from adjacent the center of said rotatable base to the edge of said base; and receptacle holders adjacent the second ends of said transfer conveyors for holding a respective one of said receptacles adjacent the second end of each transfer conveyor during the discharge of said pre-measured quantity of said foodstuffs into said respective one of said receptacles.

9. The packaging assembly of claim 8, wherein said transfer conveyors include sidewalls to assist in the conveying of said pre-measured quantity of said foodstuffs to said respective one of said receptacles.

10. The packaging assembly of claim 8, wherein each said transfer conveyors have an uneven surface for imparting a rolling motion to said pre-measured quantity of said foodstuffs as it is conveyed along each of said transfer conveyors.

11. A packaging assembly for packaging a quantity of product into a receptacle, said assembly comprising:

a plurality of transfer conveyors mounted upon a rotatable base for transferring said product to said receptacle, said conveyors having a first end for receiving said product and a second end for discharging said product into said receptacle;

said product being dispersed along said conveyors as said conveyors move between said first and second ends such that a small number of said quantity of product is sequentially deposited into said receptacle as said rotatable base rotates;

whereby said quantity of product is slowly deposited into said receptacles preventing clogging between said first end and said receptacles.

12. The packaging assembly of claim 11 further comprising a retractable door for closing the discharge end of said transfer conveyor, said door being movable between an open and closed position and when in said closed position, said door being adapted to hold said receptacle in the open position for receipt of said product.

13. The packaging assembly of claim 11, further including a single power means for driving said plurality of transfer conveyors mounted upon said rotatable base.

14. The packaging assembly of claim 11, wherein said transfer conveyors include sidewalls along the length of said transfer conveyors.

15. The packaging assembly of claim 11, wherein said transfer conveyors include a belt and sidewalls along the length of said transfer conveyors, said sidewalls are defined by inwardly projecting pyramids that have four sides meeting at an apex at approximately the center of said sidewall, the top portion of said pyramid is directed in a downward direction toward said conveyor to guide the product to the belt, the base portion of the sidewall is directed upwardly to obstruct the upward movement of the product once it passes the apex of the pyramid, and the right and left portions of the pyramid help to further guide the product.

16. The packaging assembly of claim 11, further comprising a weighing means for separating by weight said quantity of product from a bulk quantity of product and discharging said quantity of product to said first end of said transfer conveyors.

17. The packaging assembly of claim 11, wherein said transfer conveyors have an uneven surface for imparting a rolling motion to said quantity of product as it is conveyed along said transfer conveyor.

18. The packaging assembly of claim 17, wherein said uneven surface approximates a sinusoidal wave.

19. A packaging assembly for packaging portions of a material into respective receptacles, said assembly comprising:

a plurality of transfer conveyors for transferring each of said portions to said respective receptacles, each of said conveyors having a first end for receiving each of said portions and a second end for discharging each of said portions into said respective receptacle;

a weighing means for separating by weight each of said portions of said material and discharging each of said portions to said first end of each of said plurality of transfer conveyors;

said portions being dispersed along said conveyor as said conveyor moves between said first and second ends such that a small amount of said portion is sequentially deposited into said respective receptacle;

said transfer conveyors have an uneven surface for imparting a rolling motion to said portion as it is conveyed along said transfer conveyor;

whereby said portion is slowly deposited into said respective receptacle preventing clogging between said first end and said respective receptacle.

20. The packaging assembly of claim 19 further comprising a retractable door for closing the discharge end of said transfer conveyor, said door being movable between an open and closed position and when in said closed position, said door being adapted to hold said respective receptacle in the open position for receipt of said portion.

21. The packaging assembly of claim 19, wherein said plurality of transfer conveyors are mounted upon a rotatable base, said base being rotatable about a generally vertical axis; said plurality of transfer conveyors extending radially outwardly from adjacent the center of the rotatable base to the edge of said base; receptacle holders adjacent the second ends of said transfer conveyors for holding a receptacle adjacent the second end of each transfer conveyor during the discharge of said portions into said respective receptacle.

22. A packaging assembly for packaging a product into a plurality of receptacles, said assembly comprising:

a plurality of individual conveyors mounted upon a movable base, said base being adapted to move in a first direction with each of said individual conveyors being adapted to move in a second direction, said second direction being generally transverse to said first direction;

each of said conveyors being adapted to transfer a respective pre-measured quantity of said product to a respective one of said plurality of receptacles, each of said conveyors having a first end for receiving said respective pre-measured quantity of said product and a second end for discharging said respective pre-measured quantity of said product into said respective one of said plurality of receptacles;

a plurality of said conveyors each simultaneously dispersing a respective pre-measured quantity of said product, as said conveyors move in said first and second directions such that said pre-measured quantity of product is slowly deposited into a respective one of said plurality of receptacles, with said product being rapidly deposited into said plurality of receptacles.

23. The packaging assembly of claim 22, further comprising a retractable door for closing the second end of each of said conveyors, said door being movable between an open and closed position, and when in said closed position, said door being adapted to hold a respective one of said receptacles in the open position for receipt of respective pre-measured quantity of said product.

24. The packaging assembly of claim 22, wherein each of said conveyors includes a belt and sidewalls along the length of said conveyors, said sidewalls being defined by inwardly projecting pyramids that have four sides meeting at an apex at approximately the center of said sidewall, the top portion of said pyramid is directed in a downward position toward said conveyor to guide the pre-measured quantity of product to the belt, the base portion of the sidewall is directed upwardly to obstruct the upward movement of the pre-measured quantity of product once it passes the apex of the pyramid, and the right and left portions of the pyramid help to further guide the pre-measured quantity of product.

25. The packaging assembly of claim 22, wherein said individual conveyors each have an uneven surface for imparting a rolling motion to said respective pre-measured quantity of said product, as said respective pre-measured quantity of product is conveyed along said conveyor.

* * * * *